US007588249B2

(12) United States Patent
Caron et al.

(10) Patent No.: US 7,588,249 B2
(45) Date of Patent: Sep. 15, 2009

(54) SIGNATURE HOPPER WITH FLEXIBLE GUIDE

(75) Inventors: Glen Roger Caron, Deerfield, NH (US); James Aurthur Pangle, Strasburg, VA (US)

(73) Assignee: Goss International Americas, Inc., Durham, NH (US)

( * ) Notice: Subject to any disclaimer, the term of this patent is extended or adjusted under 35 U.S.C. 154(b) by 187 days.

(21) Appl. No.: 11/784,989

(22) Filed: Apr. 10, 2007

(65) Prior Publication Data

US 2008/0251984 A1 Oct. 16, 2008

(51) Int. Cl.
*B65H 31/36* (2006.01)

(52) U.S. Cl. ..... 271/221; 271/223; 271/224

(58) Field of Classification Search ..... 271/221, 271/223, 224; 414/789.1
See application file for complete search history.

(56) References Cited

U.S. PATENT DOCUMENTS

| | | | | |
|---|---|---|---|---|
| 1,865,308 | A * | 6/1932 | Evans | 271/221 |
| 2,733,064 | A * | 1/1956 | Martin | 271/224 |
| 3,382,966 | A * | 5/1968 | Califano et al. | 414/789 |
| 4,147,342 | A * | 4/1979 | Naramore | 271/221 |
| 4,436,297 | A | 3/1984 | Chandhoke | |
| 4,529,190 | A * | 7/1985 | Goodwin et al. | 271/213 |
| 5,516,092 | A | 5/1996 | Pollich | |
| 5,890,713 | A | 4/1999 | Hofmann et al. | |
| 6,082,724 | A | 7/2000 | Kahlig et al. | |
| 6,220,590 | B1 | 4/2001 | Bates et al. | |
| 6,572,101 | B2 * | 6/2003 | Kaya et al. | 271/210 |
| 6,698,748 | B1 | 3/2004 | Crowley | |
| 2002/0121736 | A1 | 9/2002 | Kaya et al. | |

* cited by examiner

*Primary Examiner*—David H Bollinger
(74) *Attorney, Agent, or Firm*—Davidson, Davidson & Kappel, LLC

(57) ABSTRACT

A hopper is provided including a pile plate, a backstop, a jogger opposite the backstop, the backstop and jogger being separated to permit a signature stack to be placed therebetween on the pile plate, and a flexible guide located opposite the jogger, adjacent to the backstop. A hopper is also provided including a pile plate, a backstop, a jogger opposite the backstop, the backstop and jogger being separated to permit a signature stack to be placed therebetween on the pile plate, and a toothed guide located opposite the jogger and adjacent to the backstop, a plurality of teeth of the toothed guide facing the signature stack. Methods are also provided.

26 Claims, 4 Drawing Sheets

SIGNATURE HOPPER WITH FLEXIBLE GUIDE

BACKGROUND

The present invention relates generally to post-press devices and more specifically to hoppers for a signature feeder.

U.S. Pat. No. 5,516,092 discloses a sheet-jogging device having at least one sheet-jogger reciprocatingly mounted in one of the side parts of the press frame so as to be adjustable to different sheet formats.

U.S. Pat. No. 5,890,713 discloses a device for forming a sheet pile in a delivery of a sheet-fed printing press. The device includes jogging plates for jogging edges of the sheet. The jogging plates are disposed perpendicularly to a lateral surface of the sheet pile and are drivable so as to move in a stationary sheet guide and to a sheet stop, respectively.

U.S. Pat. No. 6,082,724, hereby incorporated by reference herein, discloses an apparatus forming sheet material assemblages. The apparatus includes a plurality of stationary sheet material article feeders located along the conveyor assembly.

U.S. Pat. No. 6,572,101, hereby incorporated by reference herein, discloses a flexible jogger for a signature feeder. The jogger includes a back stop disposed at a first side of a hopper of the feeder and a flexible jogging element disposed at a second side of the hopper opposite the first side.

BRIEF SUMMARY OF THE INVENTION

The present invention provides a hopper including:

a pile plate;

a backstop;

a jogger opposite the backstop, the backstop and jogger being separated to permit a signature stack to be placed therebetween on the pile plate; and a flexible guide located opposite the jogger, adjacent to the backstop.

The present invention also provides a method for registering signatures in a hopper including the steps of:

receiving a plurality of signatures at an upper opening of a hopper to define a signature stack;

contacting the signature stack with a jogger; and registering the signature stack with a flexible guide.

The present invention further provides a hopper including:

a pile plate;

a backstop;

a jogger opposite the backstop, the backstop and jogger being separated to permit a signature stack to be placed therebetween on the pile plate; and a toothed guide located opposite the jogger and adjacent to the backstop, a plurality of teeth of the toothed guide facing the signature stack.

The present invention also provides a method aiding in signature delivery including the steps of:

receiving a plurality of signatures at an upper opening of a hopper to define a signature stack;

contacting the signature stack with a jogger; and aiding the plurality of signatures in the signature stack using a toothed guide.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Hoppers may be used to collect and align or register printed signatures for feeding in subsequent operations. Jogging devices may be used when loading signatures into a hopper to "jog" or move the signatures into alignment. The jogging devices improve the registration of the signatures collected in the hopper. However, this jogging motion causes vibrations which can cause misfeeds or misalignment. With lightweight products, the vibrations may cause signatures to rise and non-delivery may occur.

Figure 1:
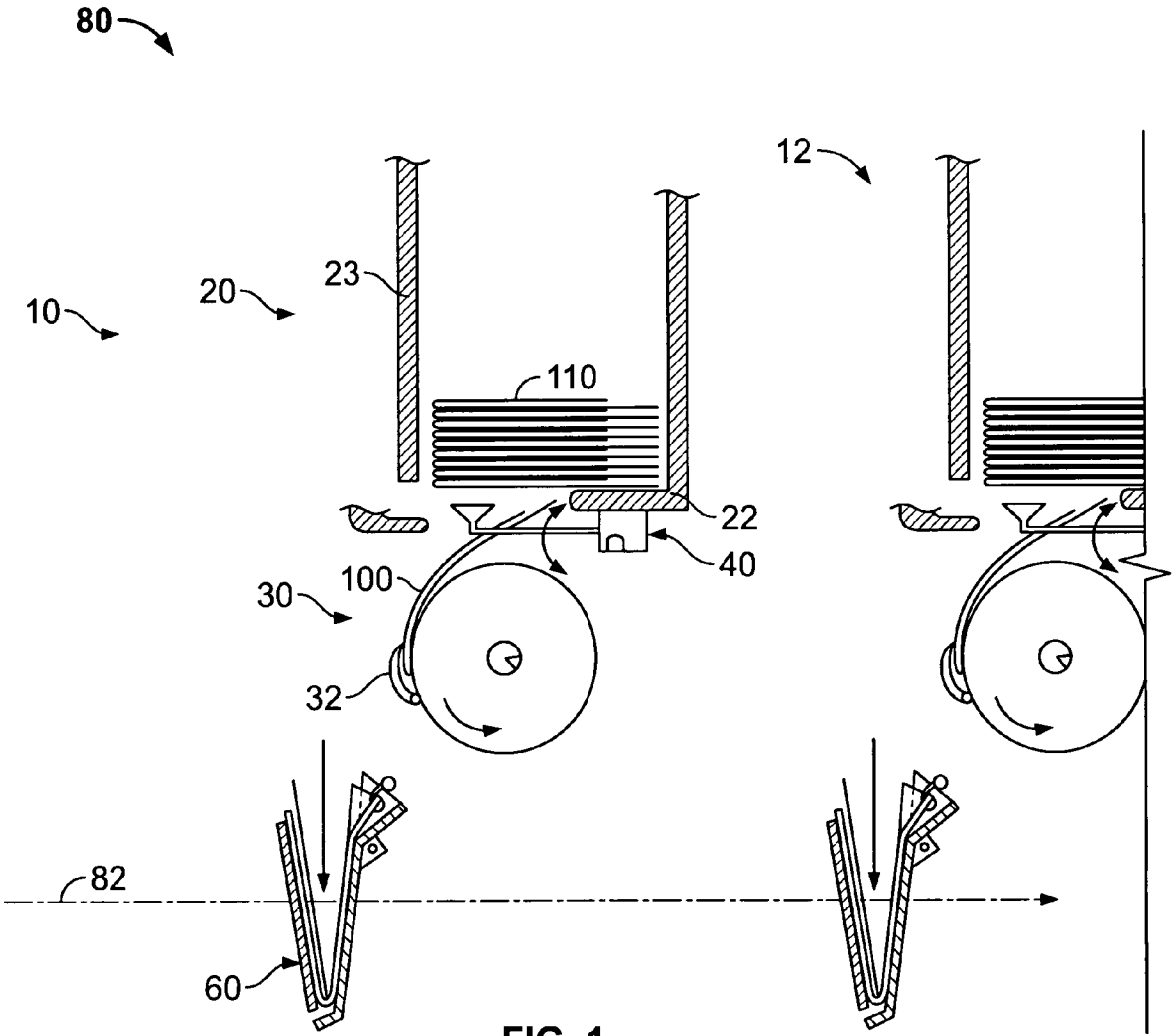
FIG. 1 shows an inserter having a signature feeder.

FIG. 1 shows a collator such as an inserter 80 having a plurality of signature feeders 10, 12. A collator may be an inserter, saddle stitcher, perfect binder or other post press collating device. Each signature feeder 10, 12 may be similar. Signature feeder 10 includes a hopper 20, feed drum 30 including grippers 32, and sucker mechanism 40. Hopper 20 includes a hopper faceplate 23 and hopper pile plate 22. Hopper 20 collects and aligns signatures to form a signature stack 110, which rest on pile plate 22. Sucker mechanism 40 may include, for example, a vacuum, and pulls a signature 100 from a bottom of signature stack 110 located in hopper 20. Grippers 32 on feed drum 30 receive signature 100 from hopper 20 and release signature 100 into a pocket 60. Pocket 60 travels along a conveyor 82. As pocket 60 passes beneath signature feeder 12, a second signature is collected in pocket 60.

Figure 2:
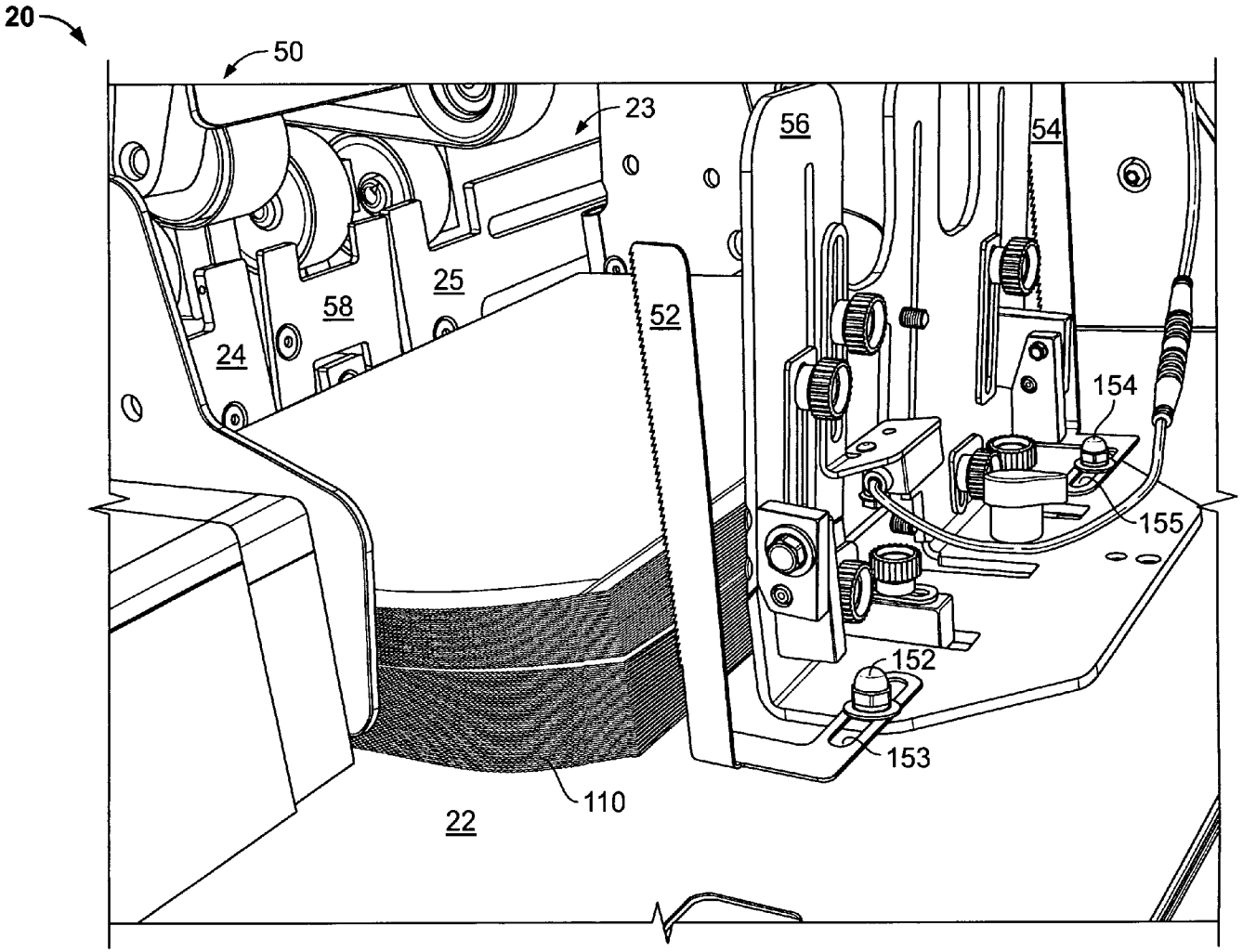
FIG. 2 shows a hopper including a jogging device according to the present invention.

FIG. 2 shows hopper 20 including jogging device 50. Jogging device 50 includes jogger 58, backstop 56 and jogging blades 52, 54. Backstop 56 is mounted on hopper pile plate 22. Jogger 58 is located between plates 24 and 25. Together plates 24 and 25 define hopper faceplate 23. Jogger 58 may be mechanically driven by a hopper loader, for example. Jogging blades 52, 54 are mounted on backstop 56. A bolt 152 in a slot 153 and a corresponding nut secure jogging blade 52 to backstop 56. Likewise, a bolt 154 in a slot 155 and a corresponding nut secure jogging blade 54 to backstop 56. The position of jogging blades 52, 54 may be adjusted as desired, for example, by adjusting the position of bolts 152, 154 in slots 153, 155, respectively. In a preferred embodiment, jogging blades 52, 54 are aligned near corners of signature stack 110.

Figure 3:
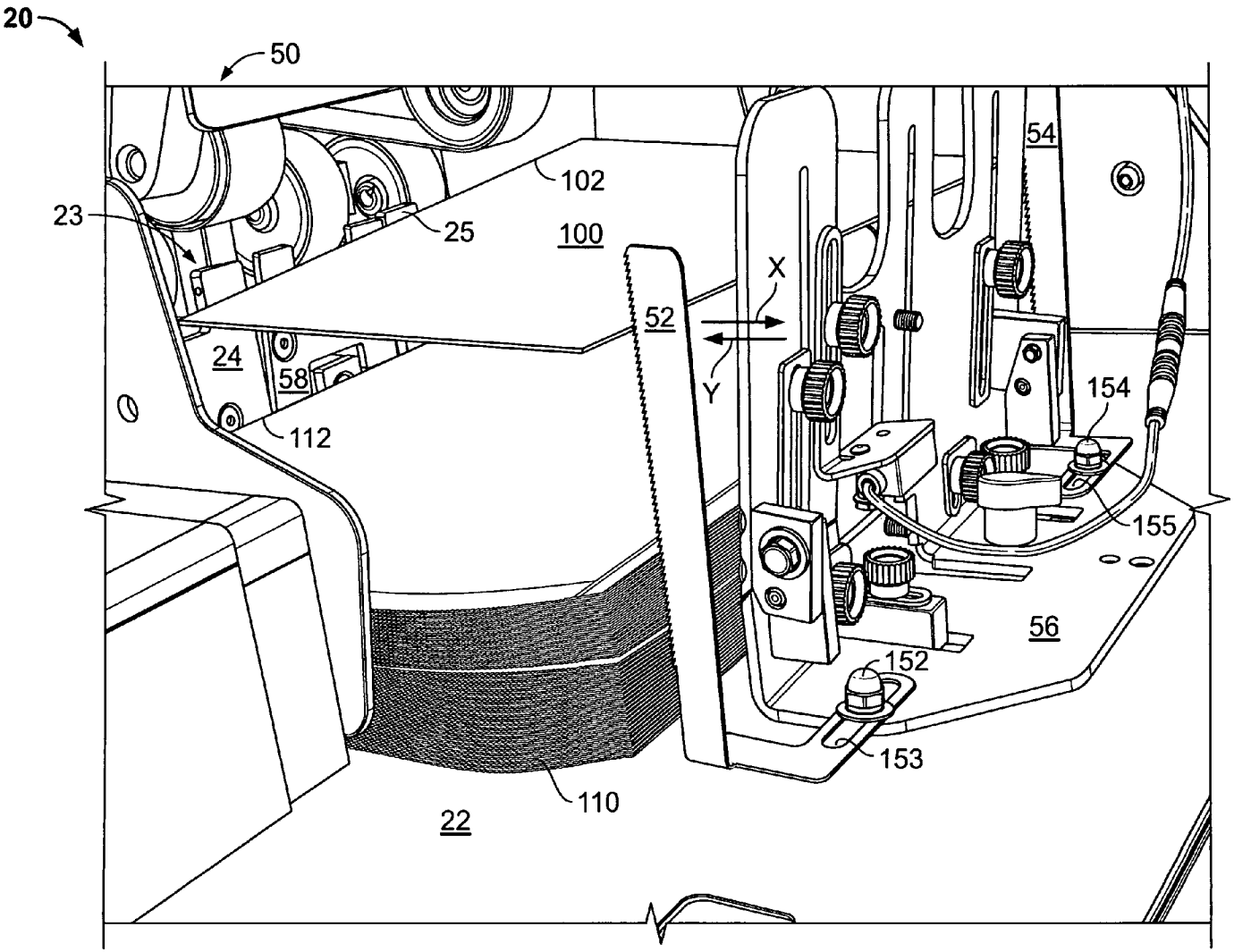
FIG. 3 shows a signature entering the hopper shown in FIG. 2.

FIG. 3 shows signature 100 entering hopper 20. Jogger 58 vibrates in such a way to align or register a spine 102 of signature 100 with spines 112 of signature stack 110 against plates 24, 25. As signature 100 enters hopper 20, jogger 58 contacts signature 100, moving signature 100 against backstop 56 and jogging blades 52, 54. Jogging blades 52, 54 are deflected away from signature stack 110 in a direction x and spring back towards signature stack 110 in a direction y pushing signature 100 and signature stack 110 towards jogger 58 and hopper faceplate 23, thereby aligning spine 102 with spines 112 against hopper faceplate 23.

Figure 4:
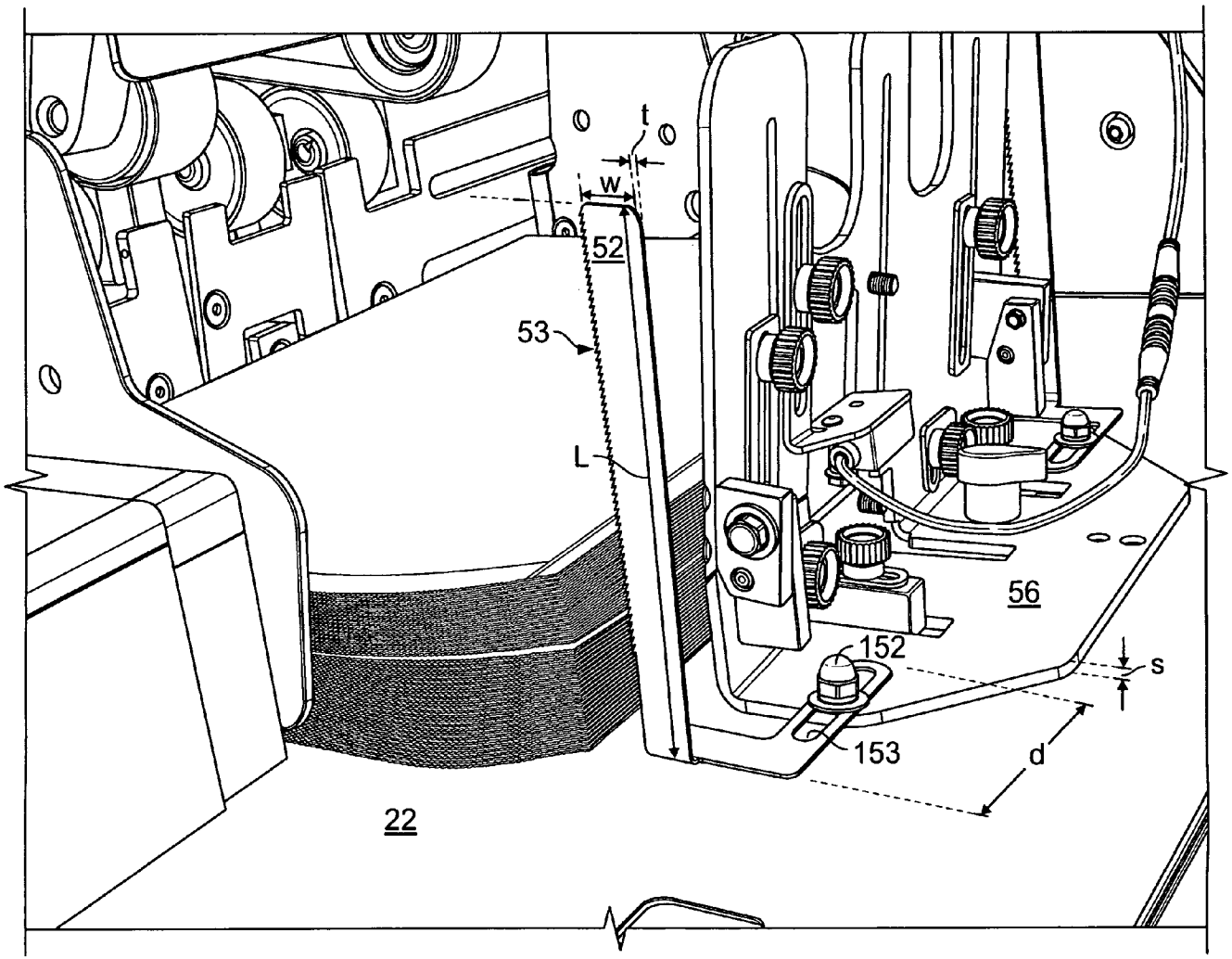
FIG. 4 shows a jogging blade of the jogging device shown in FIG. 2.

FIG. 4 shows jogging blade 52 including slot 153 and teeth 53. Jogging blade 52 preferably has a free end 51, a length l, a width w, and a thickness t. As shown in FIG. 4, blade 52 is raised off pile plate 22 by a space s. Space s allows blade 52 room for deflection and movement during jogging. As a function of the length l, width w, thickness t, materials and position, blade 52 can vibrate to aid in correcting-vibrational distortions caused by jogger 58 (FIG. 3). Jogging blade 52 may be made of, for example, spring steel and may for example, be a bent hacksaw blade. Teeth 53, also advantageously aid in holding down signature stack 110 as hopper 20 vibrates (FIG. 2). Teeth size may be selected as well, for example, based on common signature thicknesses or weights. Furthermore, jogging blade 52 may be designed so a minimal force deflects blade 52. While a flexible blade is preferred, it may be possible to use a coil spring or other spring type device as the flexible guide.

Thus, jogging device 50 may create a uniformly registered signature stack 110. The three jogging points, jogger 58 and jogging blades 52, 54, on signature stack 110 register spines 112 against hopper faceplates 24, 25. Proper registration of signature stack 110 against hopper faceplate 23 may provide reliable feeding to feed drum 30 from hopper 20 (FIG. 1). In addition, jogging blades 52, 54 may aid in jogging and delivery of lightweight signatures.

The term "signature", as defined herein, can include a single sheet or multi-sheet printed product, which may also be referred to as a book, and may be stitched or unstitched.

A lightweight signature is defined herein as a signature printed on 30 pound stock or less. The present invention may have particular advantages with such lightweight signatures or signatures having eight pages or less.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A hopper comprising:

a pile plate;

a backstop;

a jogger opposite the backstop, the backstop and jogger being separated to permit a signature stack to be placed therebetween on the pile plate; and a flexible guide located opposite the jogger, adjacent to the backstop.

2. The hopper as recited in claim 1 wherein the flexible guide is a blade.

3. The hopper as recited in claim 1 wherein the flexible guide is made of steel.

4. The hopper as recited in claim 1 wherein the flexible guide has at least one free end in a direction away from the pile plate.

5. The hopper as recited in claim 1 wherein the flexible guide is fixed at a bottom with respect to the pile plate.

6. The hopper as recited in claim 1 wherein the flexible guide is fixed to the backstop.

7. The hopper as recited in claim 1 wherein the pile plate and flexible guide are separated by a space.

8. The hopper as recited in claim 1 wherein the flexible guide includes a slot.

9. The hopper as recited in claim 1 wherein the flexible guide includes a length, a width and a thickness, the thickness being less than the width and facing the signature stack.

10. The hopper as recited in claim 1 wherein the flexible guide includes a plurality of teeth facing the signature stack.

11. The hopper as recited in claim 10 wherein a size of the teeth are a function of signatures included in the signature stack.

12. A signature feeder comprising:

the hopper as recited in claim 1.

13. A collator comprising:

a plurality of signature feeders as recited in claim 12; and a conveyor receiving signatures from the signature feeders.

14. A hopper comprising:

a pile plate;

a backstop;

a jogger opposite the backstop, the backstop and jogger being separated to permit a signature stack to be placed therebetween on the pile plate; and a toothed guide located opposite the jogger and adjacent to the backstop, a plurality of teeth of the toothed guide facing the signature stack.

15. The hopper as recited in claim 14 wherein a size of the teeth are a function of signatures included in the signature stack.

16. The hopper as recited in claim 14 wherein the toothed guide is a blade.

17. The hopper as recited in claim 14 wherein the toothed guide is made of steel.

18. The hopper as recited in claim 14 wherein the toothed guide has at least one free end in a direction away from the pile plate.

19. The hopper as recited in claim 14 wherein the toothed guide is fixed at a bottom with respect to the pile plate.

20. The hopper as recited in claim 14 wherein the toothed guide is fixed to the backstop.

21. The hopper as recited in claim 14 wherein the pile plate and toothed guide are separated by a space.

22. The hopper as recited in claim 14 wherein the toothed guide includes a slot.

23. The hopper as recited in claim 14 wherein the toothed guide includes a length, a width and a thickness, the thickness being less than the width and facing the signature stack.

24. A signature feeder comprising:

the hopper as recited in claim 14.

25. A collator comprising:

a plurality of signature feeders as recited in claim 24; and a conveyor receiving signatures from the signature feeders.

26. A method aiding in signature delivery comprising the steps of:

receiving a plurality of signatures at an upper opening of a hopper to define a signature stack;

contacting the signature stack with a jogger; and aiding the plurality of signatures in the signature stack using a toothed guide.

* * * * *